United States Patent [19]

Thacker

[11] Patent Number: 4,908,160

[45] Date of Patent: Mar. 13, 1990

[54] FIRE RETARDANT COMPOSITION

[75] Inventor: Derek A. Thacker, Isle of Man, United Kingdom

[73] Assignee: Tag Investments, Inc., Vancouver, Canada

[21] Appl. No.: 112,459

[22] Filed: Oct. 26, 1987

[30] Foreign Application Priority Data

Oct. 25, 1986 [GB] United Kingdom ..... 8625572

[51] Int. Cl.[4] ..... C09K 21/00

[52] U.S. Cl. ..... 252/608; 252/601; 252/607; 252/2; 252/7; 106/18.14; 106/18.15; 106/18.16; 106/18.17; 106/18.31; 106/18.32; 8/490; 8/127.1; 8/115.51

[58] Field of Search ..... 252/601, 607, 608, 609, 252/610, 611, 7, 2; 106/18.11, 18.14, 18.15, 18.16, 18.17, 18.31, 18.32; 169/45, 46; 8/490, 127.1, 115.51

[56] References Cited

U.S. PATENT DOCUMENTS

| | | | |
|---|---|---|---|
| 1,276,742 | 8/1918 | Ferguson | 252/7 |
| 1,908,398 | 5/1933 | Beythein | 252/7 |
| 3,172,852 | 3/1965 | Lobos | 252/5 |
| 3,484,372 | 12/1969 | Birchall | 252/7 |
| 3,673,088 | 6/1972 | Clements | 252/3 |
| 4,076,540 | 2/1978 | Stossel | 252/2 |
| 4,136,238 | 1/1979 | Hilterhaus et al. | 521/107 |
| 4,226,727 | 10/1980 | Tarpley, Jr. et al. | 252/8 |
| 4,560,485 | 12/1985 | Szekely et al. | 252/7 |

*Primary Examiner*—Howard J. Locker
*Attorney, Agent, or Firm*—Seed and Berry

[57] ABSTRACT

An anhydrous flame retardant composition comprising diammonium hydrogen phosphate, disodium hydrogen phosphate, ammonium dihydrogen phosphate, ammonium hydrogen phosphate, sodium hydrogen carbonate and a surfactant. The composition can be made up into an aqueous solution and used to impregnate textile materials to impart flame retardancy thereto.

2 Claims, No Drawings

FIRE RETARDANT COMPOSITION

The present invention relates to fire retardant compositions suitable for the treatment of a broad range of natural and synthetic material and combinations thereof.

A high proportion of structural components, soft furnishings, furniture clothing and artifacts in every day use are of flammable construction. Those made of natural materials generally produce flammable vapor when subjected to heat. Ignition of this vapor increases the local heat, engendering further vapor production and therefore flame spread. Synthetic, or man-made materials frequently melt and ignite, spreading the fire not only by heat generation, but also by dripping detritus. Both flame spread systems produce fumes which present a danger to life, but in the case of most synthetic materials these fumes assume an even more critical role due to the presence of highly toxic by-products such as hydrogen cyanide and nitrile derivatives.

A need therefore exists for a general purpose retardant which will impart maximum protection to the widest possible range of materials and, by slowing or preventing the spread of flames, will reduce the volume of fumes generated. At the same time the retardant mixture chosen should not in itself have any toxic properties before pyrolyation and should add little if anything to the dangerous fumes produced on pyrolysis. Furthermore, the retardant should present no hazard in handling or application.

Thus a need exists for such general purpose fire and flame retardant which will have beneficial effect whether applied to finished goods or incorporated in manufacture. It is considered necessary that such a retardant should avoid the shortcomings of many retardants currently available, in that it should not change the characteristics of the material to which it is applied, or in which it is incorporated, while at the same time fulfilling the above conditions of retardancy.

According to the present invention a fire retardant composition comprises a mixture including: diammonium hydrogen phosphate, disodium hydrogen phosphate, ammonium dihydrogen phosphate, ammonium hydrogen carbonate, sodium hydrogen carbonate and a surfactant-containing composition.

The surfactant-containing composition is preferably S.G. SIGMA 7 (marketed by Fowler Inc. of Oklahoma).

The amounts of the materials set out in the following description and claims may have a tolerance of ±5% on the stated proportions or percentages.

In a first preferred composition the ratio by weight of diammonium hydrogen phosphate to disodium hydrogen phosphate is 1:0.11 to 1:0.19, more preferably 1:1.15.

In a second preferred composition the ratio by weight of diammonium hydrogen phosphate to ammonium dihydrogen phosphate is 1:1.6 to 1:2.1, more preferably 1:1.83.

In a third preferred composition the ratio by weight of diammonium hydrogen phosphate to ammonium hydrogen phosphate is 1:1 to 1:1.5, more preferably 1:1.25.

In a fourth preferred composition the ratio by weight of diammonium hydrogen phosphate to sodium hydrogen carbonate is 1:0.35 to 1:0.58, preferably 1:0.46.

In a fifth preferred composition the ratio by weight of diammonium hydrogen phosphate to S.C.SIGMA 7 is 1:0.025 to 1:0.083, more preferably 1:0.055.

In particularly preferred compositions the proportions of all of the ingredients are as defined above.

An anhydrous mixture in accordance with this invention may be incorporated during manufacture into various materials including rigid polyurethane or other foamed materials, building boards including wood chip board and backings for carpets.

An aqueous solution of the composition in accordance with the invention, which may contain up to 55% w/w of composition, may be used to impregnate materials such as furnishing fabrics, clothing, timber, non-woven fabrics, paper and paper products including wallpaper.

The pH of such a solution is preferably within the range 5 to 8, more preferably approximately 6.4.

An additional surfactant may be added to solutions used to treat materials having a high surface tension such as carpets, uniforms and the like. An amount of 0.25% based on the weight of the solution, of a neutral detergent may be employed.

The invention has been found to be particularly applicable in treatment of upholstery, for example in aircraft, which are subject to contamination by human occupancy.

Preferred compositions in accordance with this invention may incorporate as ingredient such as gum ammoniac to prevent leaching of the aforementioned ingredients. A bactericide such as chlorhexidine gluconate may also be incorporated.

Compositions in accordance with this invention are advantageous in being non-irritant when tested in accordance with the F.D.A. Handbook, Primary Irritation Skin Test. Furthermore, a single composition in accordance with this invention may be used to treat a wide variety of substrates, avoiding any need for a user to identify for example whether a particular textile is composed of natural or synthetic fibres before selection of an appropriate retardant.

I claim:

1. A fire-retardant composition suitable for use in or in association with natural or synthetic materials comprising a mixture of:

(a) about one part by weight diammonium hydrogen phosphate;

(b) about 0.11 to about 0.19 parts by weight disodium hydrogen phosphate;

(c) about 1.6 to about 2.1 parts by weight ammonium dihydrogen phosphate;

(d) about 1.0 to about 1.5 parts by weight ammonium hydrogen phosphate;

(e) about 0.35 to about 0.58 parts by weight sodium hydrogen carbonate; and (f) about 0.025 to about 0.083 parts by weight surfactant.

2. A composition as claimed in claim 1 wherein the composition is used as a fire retardant for textile materials.

* * * * *